US008333636B2

(12) United States Patent
Takeichi et al.

(10) Patent No.: US 8,333,636 B2
(45) Date of Patent: Dec. 18, 2012

(54) EYEGLASS LENS PROCESSING APPARATUS

(75) Inventors: Kyoji Takeichi, Gamagori (JP); Hirokatsu Obayashi, Toyokawa (JP)

(73) Assignee: Nidek Co., Ltd., Aichi (JP)

( * ) Notice: Subject to any disclaimer, the term of this patent is extended or adjusted under 35 U.S.C. 154(b) by 936 days.

(21) Appl. No.: 12/329,916

(22) Filed: Dec. 8, 2008

(65) Prior Publication Data

US 2009/0176442 A1 Jul. 9, 2009

(30) Foreign Application Priority Data

Dec. 6, 2007 (JP) ..... 2007-316344

(51) Int. Cl.
*B24B 13/00* (2006.01)
*B24B 49/16* (2006.01)

(52) U.S. Cl. ..... 451/8; 451/10; 451/43

(58) Field of Classification Search ..... None
See application file for complete search history.

(56) References Cited

U.S. PATENT DOCUMENTS

| | | | | |
|---|---|---|---|---|
| 5,333,412 | A | 8/1994 | Matsuyama | |
| 6,579,155 | B1 | 6/2003 | Luderich et al. | |
| 7,335,087 | B2 | 2/2008 | Tanaka et al. | |
| 2003/0087584 | A1 | 5/2003 | Shibata | |
| 2004/0048555 | A1* | 3/2004 | Jinbo | 451/43 |
| 2004/0192170 | A1 | 9/2004 | Mizun | |
| 2007/0135019 | A1 | 6/2007 | Tanaka et al. | |
| 2009/0039825 | A1* | 2/2009 | Stancu et al. | 318/799 |

FOREIGN PATENT DOCUMENTS

| | | | |
|---|---|---|---|
| JP | 4-93164 | A | 3/1992 |
| JP | 2003-145328 | A | 5/2003 |
| JP | 2004-25561 | A | 1/2004 |
| JP | 2005-125491 | A | 5/2005 |
| JP | 2006-334701 | A | 12/2006 |
| JP | 2007-152439 | A | 6/2007 |

OTHER PUBLICATIONS

Japanese Office Action for Patent Application No. 2007-316344, issued Sep. 18, 2012.

* cited by examiner

*Primary Examiner* — Kakali Chaki
*Assistant Examiner* — Walter Hanchack
(74) *Attorney, Agent, or Firm* — Sughrue Mion, PLLC

(57) ABSTRACT

An eyeglass lens processing apparatus includes a processing control unit (50) which in the soft processing mode, roughs the lens such that the torque threshold value is set to a value Tθs lower than the threshold value TθN of a normal processing mode, and when torque detected by a sensor unit does not exceed the threshold value Tθs, a axis-to-axis distance varying unit or a lens rotating unit is controlled so that a cutting amount per rotation of the lens reaches a threshold cutting amount, and when the detected torque exceeds the threshold value Tθs, the axis-to-axis distance varying unit or the lens rotating unit is controlled so that the torque becomes lower than the threshold value Tθs to decrease the threshold cutting amount.

6 Claims, 8 Drawing Sheets

EYEGLASS LENS PROCESSING APPARATUS

BACKGROUND OF THE INVENTION

The present invention relates to an eyeglass lens processing apparatus for processing a periphery of an eyeglass lens.

In eyeglass lens processing apparatuses used by an optician, a mainly used apparatus is that in which while an eyeglass lens held by a lens chuck shaft is rotated, an axis-to-axis distance between a grindstone spindle attached with roughing grindstone and the lens chuck shaft is changed based on target lens shape data, and the periphery of the lens is roughened by the roughing grindstone. In roughing a plastic lens by the roughing grindstone, a down-cut system in which a rotating direction of roughing grindstone 166 and that of an eyeglass lens LE are set opposite to each other, as shown in FIG. 1A, is adopted. The reason for this is that when an up-cut system in which the rotating direction of the roughing grindstone 166 and that of the lens LE are the same is adopted, as shown in FIG. 1B, if the lens LE is deeply cut by the roughing grindstone 166, a force for pulling the lens LE to a grindstone side is increased, as indicated by an arrow FB, and thus, a so-called axial deviation, in which an axial angle of the lens LE is deviated relative to a rotating angle of the lens chuck shaft, is greatly generated. On the other hand, in the down-cut system, even when the lens LE is deeply cut by the roughing grindstone 166, the force for pulling the lens LE to the grindstone 166 side, as indicated by an arrow FA, does not act (or weak), and thus, the generation of the axial deviation is small.

In the down-cut system, the generation of the axial deviation is small. However, recently, there is a water-repellent lens of which the lens surface is coated with a water-repellent substance to which water, or oil, etc., does not easily adhere. At the time of processing the water-repellent lens, axial deviation tends to occur. As a method for alleviating the axial deviation, there has been proposed a technique in which a rotation torque of a lens chuck shaft for holding a lens is detected and a lens rotation speed is decelerated so that the rotation torque does not exceed a predetermined value, or an axis-to-axis distance between the lens chuck shaft and a grindstone spindle is moved in a direction into which the distance is enlarged (JP-A-2004-25561 (US 2004-0192170)). As another method, there has been proposed a technique in which a lens is rotated at a constant speed, and an axis-to-axis distance between a lens chuck shaft and a grindstone spindle is varied so that a cutting amount while the lens makes one rotation is substantially constant (JP-A-2006-334701).

However, in the down-cut system, there is a problem in that a processing sound is larger at the time of roughing as compared to the up-cut method. To suppress the generation of the large processing sound in the down-cut system, some measures there have been introduced. However, there is no example in which the effect is actually provided. When the up-cut system is adopted, the problem of the aforementioned axial deviation is present even in a normal lens, and in the water-repellent lens, the problem of the axial deviation becomes even more conspicuous.

As a method for alleviating the axial deviation in the water-repellent lens, the technique of JP-A-2004-25561 (US 2004-0192170) was adopted in the down-cut system. As a result, due to advancement of the roughing, a case where the rotation torque is applied to a plus side opposite to the rotating direction of the lens and a case where the rotation torque is applied to a minus side which is the same direction as the rotating direction of the lens frequently occur. Thus, controlling of a change of the axis-to-axis distance or the lens rotation speed is difficult, and therefore, its application is difficult. Further, when the cutting amount increases, a permissible value of the torque applied to the lens is rapidly exceeded, and when it is controlled so that the lens is rapidly kept apart from the grindstone so as to decrease the torque, the lens chuck shaft is vibrated in up and down directions.

On the other hand, at the time of adopting the technique of JP-A-2006-334701 in the down-cut system, when a lens thickness is unknown, there is a need for estimating the thickest lens and setting the cutting amount to very small amount for the sake of safety so that no axial deviation is generated. In this case, the number of rotations of the lens is increased, and thus, the processing time is lengthened. Even when the lens thickness is measured, accurate measurement of the lens thickness is not easy, and in an astigmatic lens, the lens thickness differs depending on each radial angle, and thus, it is even more difficult to know the lens thickness over the entire lens.

SUMMARY OF THE INVENTION

An object of the present invention is to provide an eyeglass lens processing apparatus, capable of reducing generation of an axial deviation of a lens while reducing generation of a large processing sound at the time of roughing.

In order to achieve the object, the present invention provides the following arrangements.

(1) An eyeglass lens processing apparatus comprising:

a lens rotating unit which includes a motor for rotating a lens chuck shaft for holding an eyeglass lens;

a grindstone rotating unit which includes a motor for rotating a grindstone spindle attached with a roughing grindstone for roughing a periphery of the lens;

an axis-to-axis distance varying unit which includes a motor for varying an axis-to-axis distance between the lens chuck shaft and the grindstone spindle;

a sensor unit which includes a sensor for detecting a torque applied to the lens chuck shaft at the time of roughing of the lens by the roughing grindstone;

a mode selecting switch which switches and selects a normal processing mode and a soft processing mode;

a processing control unit which in the normal processing mode, sets a torque threshold value to a value TθN, and controls the axis-to-axis distance varying unit or the lens rotating unit so that the torque detected by the sensor unit is equal to or less than the value TθN, and in the soft processing mode, sets the torque threshold value to a value Tθs lower than the value TθN, and when the torque detected by the sensor unit does not exceed the value Tθs, controls the axis-to-axis distance varying unit or the lens rotating unit so that a cutting amount per rotation of the lens reaches a predetermined cutting amount, and when the detected torque exceeds the value Tθs, controls the axis-to-axis distance varying unit or the lens rotating unit so that the torque becomes lower than the value Tθs to decrease the cutting amount.

(2) The eyeglass lens processing apparatus according to (1), wherein the processing control unit controls the lens rotating unit and the grindstone rotating unit to rotate the lens chuck shaft and the roughing grindstone in the same direction.

(3) The eyeglass lens processing apparatus according to (1), wherein the processing control unit controls the axis-to-axis distance varying unit or the lens rotating unit to sequentially increase a cutting amount per rotation of the lens.

(4) The eyeglass lens processing apparatus according to (1), wherein in the soft processing mode, the processing control unit controls the axis-to-axis distance varying unit or the lens rotating unit to change a decreasing amount of the cutting amount according to a torque amount exceeding the threshold value Tθs.

(5) The eyeglass lens processing apparatus according to (1), wherein the sensor unit includes a sensor for detecting a rotating angle of the lens chuck shaft and detects the torque based on a deviation between a rotation command signal to the motor provided in the lens rotating unit and a rotating angle of the lens chuck shaft detected by the sensor.

(6) The eyeglass lens processing apparatus according to (1), wherein in the normal processing mode, the processing control unit controls the axis-to-axis distance varying unit or the lens rotating unit so that the cutting amount per rotation of the lens reaches a predetermined cutting amount larger than the predetermined cutting amount in the soft processing mode.

DETAILED DESCRIPTION OF THE PREFERRED EMBODIMENTS

Figure 2:
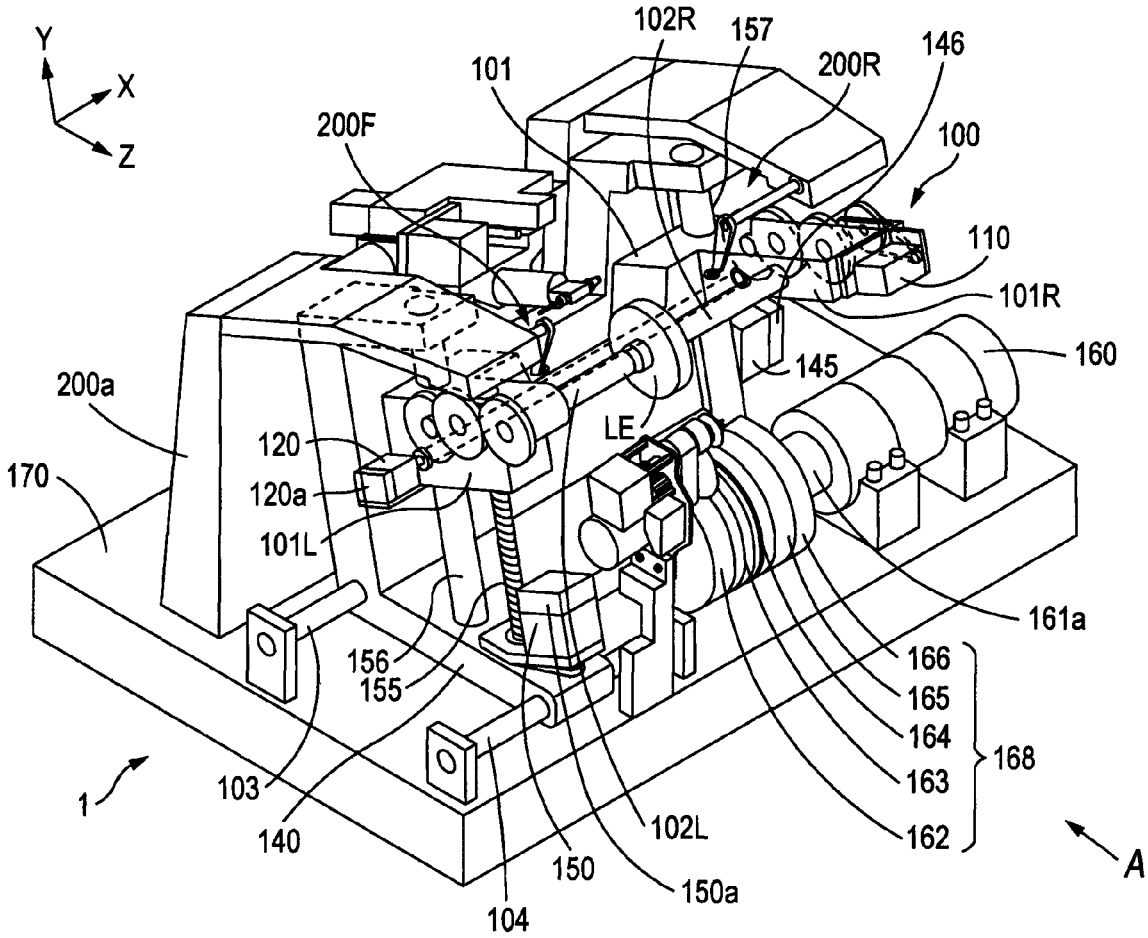
FIG. 2 is a schematic configuration diagram of a processing portion of an eyeglass lens processing apparatus.

Hereinafter, an embodiment of the present invention is described based on the drawings. FIG. 2 is a schematic configuration diagram of a processing portion of an eyeglass lens processing apparatus according to the present invention.

A carriage portion 100 is mounted onto a base 170 of a processing apparatus main body 1. An eyeglass lens LE to be processed is held (chucked) by lens chuck shafts (lens rotating shafts) 102L and 102R of a carriage 101, and a peripheral edge of the lens is pressed and processed by a grindstone group 168 coaxially attached to a grindstone spindle 161*a*. The grindstone group 168 includes a roughing grindstone 162 for glass, a high curve bevel-finishing (beveling) grindstone 163 having a bevel slope to form a bevel in a high curve lens, a finishing grindstone 164 having a V groove (bevel groove) VG to form a bevel in a low curve lens and a flat processing surface, a flat polishing grindstone 165, and a roughing grindstone 166 for plastic. The grindstone spindle 161*a* is rotated by a motor 160. By these components, a grindstone rotating unit is configured.

The lens chuck shaft 102L is held by a left arm 101L of the carriage 101 and the lens chuck shaft 102R is held by a right arm 101R rotatably and coaxially. The lens chuck shaft 102R is moved toward the lens chuck shaft 102L by a motor 110 attached to the right arm 101R, and the lens LE is held by the two lens chuck shafts 102R and 102L. Further, the two lens chuck shafts 102R and 102L are rotated in synchronization with each other by a motor 120 attached to the left arm 101L through a rotation transmission mechanism such as a gear. Accordingly, a lens rotating mechanism is configured in this manner. A rotating shaft of the motor 120 is provided with an encoder 120*a* for detecting rotations of the lens chuck shafts 102L and 102R. The encoder 120*a* is used as a sensor for detecting a torque applied to the lens chuck shafts 102L and 102R at the time of processing the peripheral edge of the lens.

The carriage 101 is mounted on a movement support base 140 capable of moving in an X-axis direction along shafts 103 and 104 extending in parallel to the lens chuck shafts 102R and 102L and the grindstone spindle 161*a*. A ball screw (not shown) extending in parallel to the shaft 103 is attached to the rear portion of the support base 140, and the ball screw is attached to a rotating shaft of an X-axis movement motor 145. By the rotation of the motor 145, the carriage 101 as well as the support base 140 is linearly moved in an X-axis direction (an axial direction of the lens chuck shaft). Accordingly, these components constitute an X-axis direction moving unit. The rotating shaft of the motor 145 is provided with an encoder 146 as a detector for detecting a movement in the X-axis direction of the carriage 101.

The support base 140 is fixed with shafts 156 and 157 extending in a Y-axis direction (a direction into which an axis-to-axis distance between the lens chuck shafts 102L and 102R and the grindstone spindle 161*a* is changed). The carriage 101 is mounted on the support base 140 so as to be movable in a Y-axis direction along the shafts 156 and 157. A Y-axis movement motor 150 is fixed to the support base 140. The rotation of the motor 150 is transmitted to a ball screw 155 extending in the Y-axis direction, and the carriage 101 is moved in a Y-axis direction by a rotation of the ball screw 155. Accordingly, a Y-axis direction moving unit (axis-to-axis distance varying unit) is configured in this manner. A rotating shaft of the motor 150 is provided with an encoder 150*a* as detector for detecting a movement of the carriage 101 in the Y-axis direction.

Figure 3:
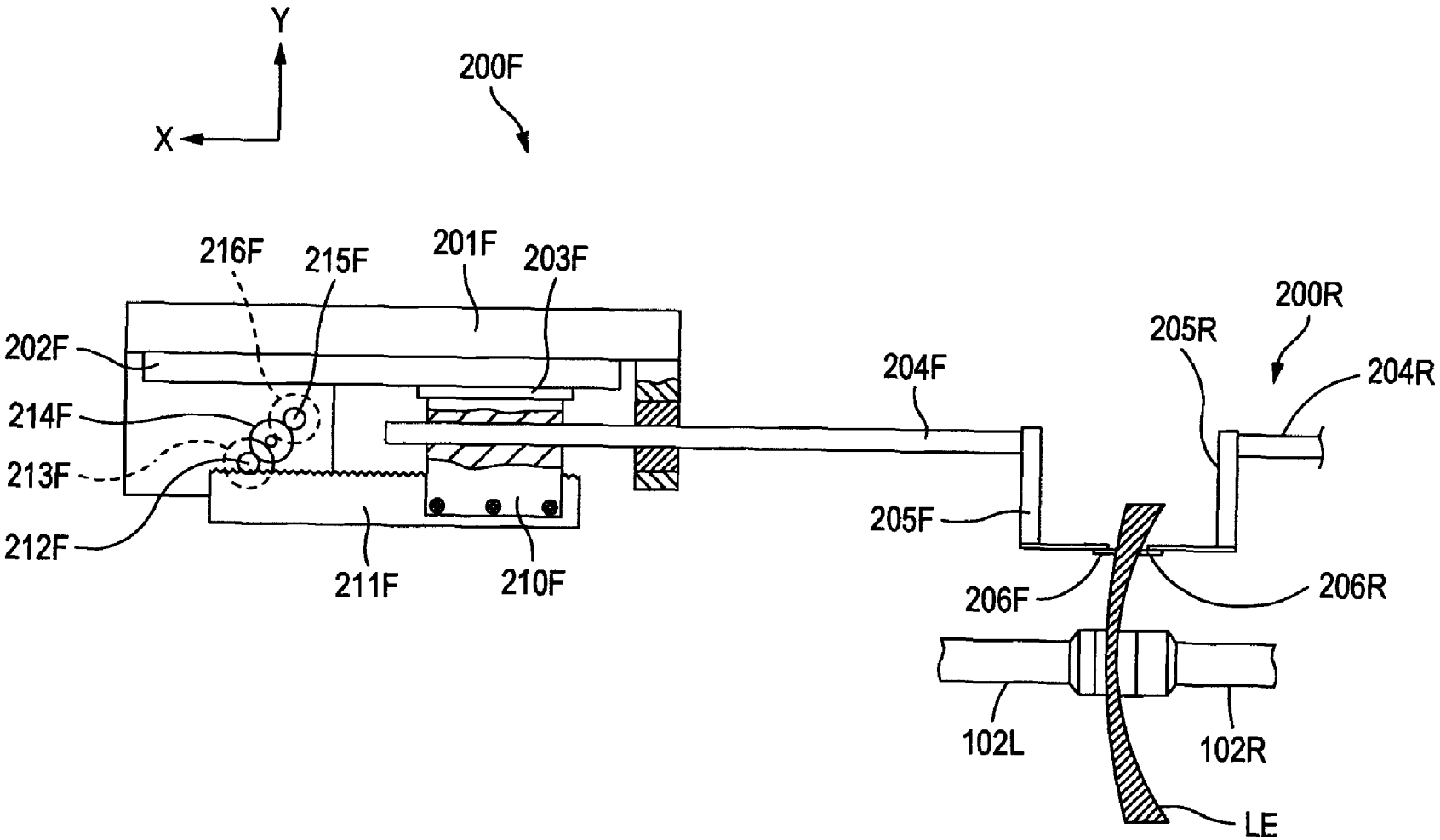
FIG. 3 is a schematic configuration diagram of a lens edge position measurement portion.

In FIG. 2, lens edge position measurement portions (lens edge detecting units) 200F and 200R are arranged above the carriage 101. FIG. 3 is a schematic configuration diagram of the measurement portion 200F for measuring a lens edge of a lens front surface. An attaching support base 201F is fixed to a support base block 200*a* fixedly arranged on the base 170 in FIG. 2, and a slider 203F is slidably attached on a rail 202F fixed on the attaching support base 201F. The slider 203F is fixed to a slide base 210F, and the slide base 210F is fixed top a measurement arm 204F. An L-shaped hand 205F is fixed to the distal end portion of the measurement arm 204F, and a measurement portion 206F is fixed to the distal end of the hand 205F. The measurement portion 206F is brought into contact with a front-side refractive surface of the lens LE.

A rack 211F is fixed to a lower end portion of the slide base 210F. The rack 211F meshes with a pinion 212F of an encoder 213F fixed on the attaching support base 201F. A rotation of a motor 216F is transmitted to the rack 211F via a gear 215F, an idle gear 214F, and the pinion 212F, thereby moving the slide base 210F in the X-axis direction. During the measurement of the lens edge position, the motor 216F presses the measurement portion 206F against the lens LE at the constant force all the time. The pressing force of the measurement portion 206F applied from the motor 216F to the lens refractive surface is set to a small force in order to prevent a scratch of the lens refractive surface. As means for applying a pressing force of the measurement portion 206F against the lens refractive surface, pressure applying device such as spring may be employed. The encoder 213F detects a measurement position in the X-axis direction of the measurement portion 206F by detecting the measurement position of the slide base 210F. On the basis of the movement position information, the rotating angle information of the lens chuck shafts 102L and 102R, and Y-axis movement information the edge position on the front surface of the lens LE (and the lens front surface position) is measured.

Since a configuration of the measurement portion 200R for measuring the edge of a rear surface of the lens LE is symmetric to the configuration of the measurement portion 200F, "F" of the reference numerals given to the components of the measurement portion 200F shown in FIG. 2 is exchanged with "R", and the description thereof will be omitted.

During the measurement of the lens edge position, the measurement portion 206F is brought into contact with the front surface of the lens and the measurement portion 206R is brought into contact with the rear surface of the lens. When the carriage 101 is moved in the Y-axis direction based on target lens shape data, and the lens LE is rotated n the basis of lens shape data (target lens shape data) in this state, the edge positions of the lens front surface and the lens rear surface are measured for processing a peripheral edge of the lens. In the case that the lens edge position measurement portion is configured so that the measurement portion 206F and the measurement portion 206R can integrally move in the X-axis direction, the lens front surface and the lens rear surface are separately measured.

Thus, for configurations of the carriage portion 100, and the lens edge position measurement portions 200F and 200R, those described in JP-A-2003-145328 (US 2003-087584) can be basically used, and therefore, a detailed explanation will be omitted.

It is noted that the X-axis direction moving means and the Y-axis direction moving means in the eyeglass lens processing apparatus in FIG. 2 may be configured so that the grindstone spindle 161*a* is relatively moved in the X-axis direction and the Y-axis direction relative to the lens chuck shafts (102L and 102R). Further, the lens edge position measurement portions 200F and 200R may be configured so that the measurement portions 206F and 206R are moved in the Y-axis direction relative to the lens chuck shafts (102L and 102R).

Figure 4:
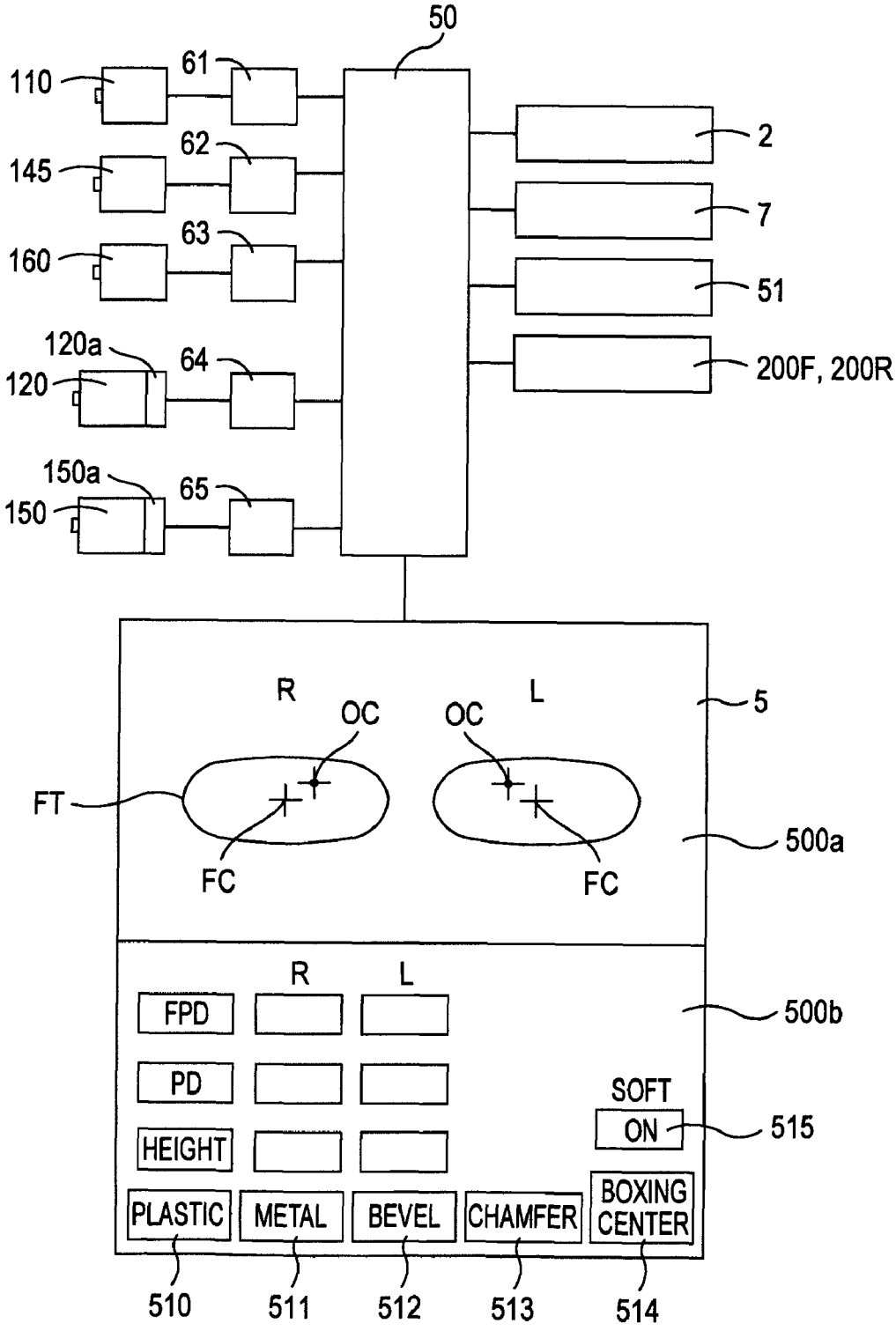
FIG. 4 is a block diagram of a control system of an eyeglass lens processing apparatus.

FIG. 4 is a block diagram of a control system of the apparatus. A control portion 50 is connected to an eyeglass frame shape measurement portion 2 (a portion described in JP-A-H4-93164 (U.S. Pat. No. 5,333,412), etc., can be used therefor), a switch portion 7, a memory 51, the lens edge position measurement portions 200F and 200R, a touch-panel type display 5 as display means and input means, etc. The control portion 50 receives an input signal from a touch panel function provided in the display 5 so as to control display of diagrams and information of the display 5. The control portion 50 is also connected to the motors 110, 145, 160, 120, and 150 of the carriage portion 100 via drivers 61, 62, 63, 64, and 65, respectively.

Subsequently, the rotating direction of the lens LE according to the present apparatus will be explained. In the present apparatus, in order to reduce the generation of a large processing sound at the time of roughing, the up-cut system (a system in which the lens LE is rotated in the same direction as that of the roughing grindstone 166) is adopted for the rotation of the lens LE at the time of roughing. Hereinafter, explained are reasons for reducing the generation of the large processing sound in the up-cut system, which is not the case in the down-cut system.

Figure 6A:
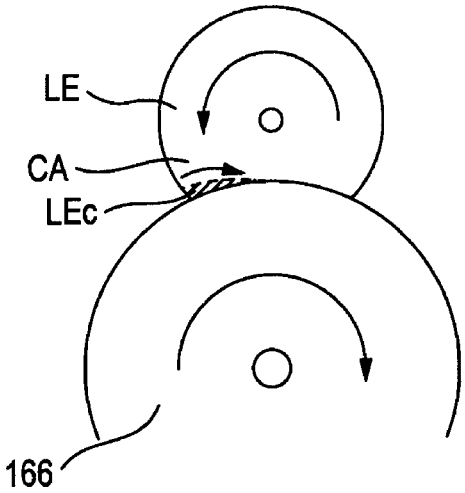
FIG. 6A is an explanatory diagram of a roughened state of a lens according to a down-cut system.
Figure 6B:
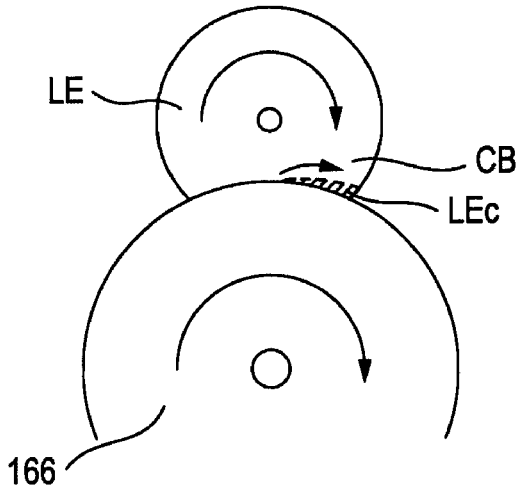
FIG. 6B is an explanatory diagram of a roughened state of a lens according to an up-cut system.

FIG. 6A is a diagram schematically showing a roughened state of the lens LE according to the down-cut system, and FIG. 6B is a diagram schematically showing a roughened state of the lens LE according to the up-cut system. In each figure, a shaded portion LEc indicates a portion to be cut and ground by the roughing grindstone 166 when the lens is rotated by a certain angle.

In the down-cut system in FIG. 6A, when the lens LE is rotated by a certain angle, as a result of the rotation of the roughing grindstone 166, the shaded portion LEc is ground as indicated by an arrow CA toward the center from the outer peripheral end of the lens LE. When the lens LE is cut and ground from the outer peripheral end, an impact tends to be applied to the lens LE. When intermittent impact is applied at each time the lens is rotated by a certain angle, the lens LE is vibrated. This appears to be a factor for generating the large processing sound. On the other hand, in the up-cut system in FIG. 6B, when the lens LE is rotated by a certain angle, as a result of the rotation of the roughing grindstone 166, the shaded portion LEc is gradually ground as indicated by an arrow CB from a position close to the rotation center of the lens LE toward the outer peripheral end of the lens LE. When the lens LE is cut and ground from the position close to the rotation center, the impact to the lens is weak, and thus, the vibration of the lens LE is small. This appears to be a factor for generating a smaller processing sound in the up-cut system as compared to the down-cut system.

Subsequently, a processing operation of the present apparatus will be explained. First, an operator inputs target lens shape data of an eyeglass frame F. The target lens shape data (rn, θn) (n=1, 2, 3, . . . , N) of the eyeglass frame F measured by the eyeglass frame shape measurement portion 2 is input by depressing a switch provided in the switch portion 7 and stored into the memory 51. A target lens shape diagram FT based on the input target lens shape data is displayed on a screen 500*a* of the display 5. This results in a state of being capable of inputting layout data of a pupillary distance (PD value) of a wearer, a frame pupillary distance (FPD value) of the eyeglass frame F, a height of an optical center OC relative to a geometrical center FC of the target lens shape, etc. The layout data can be input by operating a predetermined touch key displayed on a screen 500*b*. Further, by touch keys 510, 511, 512, and 513, processing conditions such as a material quality of the lens, types of frames, a processing mode, and presence or absence of chamfering can be set.

Prior to the processing of the lens LE, the operator uses a well-known blocking device to fix a cup or fixing jig to the lens front surface of the lens LE. At this time, there are two modes, i.e., an optical center mode for fixing the cup to the optical center OC of the lens LE and a boxing center mode for fixing the cup to the geometrical center FC of the target lens shape. The optical center mode and the boxing center mode can be selected by the touch key 514. Herein, a case of using the boxing center mode will be explained. That is, the geometric center FC of the target lens shape is held to the lens chuck shafts 102R and 102L so as to serve as the rotation center of the lens (processing center of the lens).

In a water-repellent-coated slippery lens, an axial deviation tends to generate more frequently at the time of roughing. A soft processing mode used at the time of processing a slippery lens and a normal processing mode used at the time of processing a normal plastic lens not applied with water-repellent coating can be selected by the touch key 515 (mode selection switch). First, a case where the soft processing mode is selected is explained.

When a start switch of the switch 7 is depressed after the lens LE is held by the lens chuck shaft, the lens edge position measurement portions 200F and 200R are activated by the control portion 50, and the edge positions of the lens front surface and the lens rear surface are detected based on the target lens shape data. When beveling is set, path data of a bevel position is determined based on the detection result of the edge positions of the lens front surface and the lens rear surface, and the target lens shape data (a well-known method can be used to calculate bevel path data).

Figure 5:
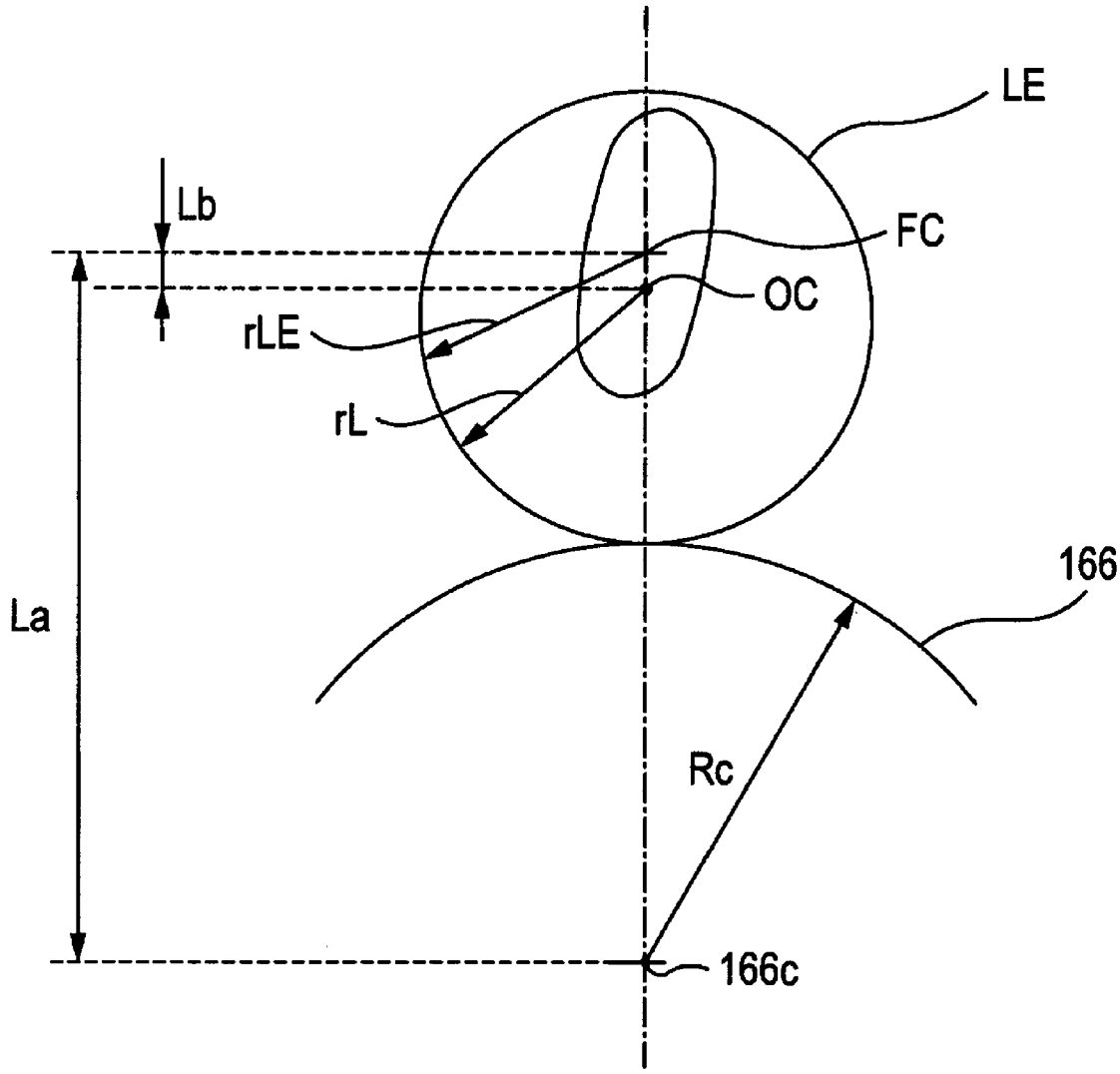
FIG. 5 is a diagram describing a measuring step for obtaining an outer diameter of an unprocessed lens.

Upon completion of the measurement of the lens shape, the process shifts to roughing by the roughing grindstone 166. At the time of roughing, a measuring step for obtaining an outer diameter of an unprocessed lens LE is first executed. By the movement of the lens chuck shafts 102R and 102L in the X-axis direction, the lens LE is moved to a position of the roughing grindstone 166. Subsequently, the lens LE is moved to the grindstone 166 side by drive of the motor 150. At the time of starting the roughing, as shown in FIG. 5, the lens LE is rotated by drive of the motor 120 so that the geometric center FC of the target lens shape, the optical center OC of the lens LE, and the rotation center 166C of the roughing grindstone 166 (center of the grindstone spindle 161*a*) are positioned on a straight line (on the Y-axis). By drive of the motor 150, the lens chuck shafts 102R and 102L are moved in the Y-axis direction to bring the lens LE into contact with the roughing grindstone 166. At this time, the control portion 50 compares a drive pulse signal of the motor 150 with a pulse signal output from the encoder 150*a*, and when a deviation in which the value is equal to or more than a predetermined value occurs between the both signals, the control portion 50 detects that the lens LE is in a state of being brought into contact with the roughing grindstone 166. The control portion 50 determines a radius rL which is an outer diameter of the lens LE according to the following equation, based on an axis-to-axis distance La between the centers (geometric centers FC of the target lens shape) of the lens chuck shafts 102R and 102L at this time and the center 166C of the grindstone spindle 161*a*, a distance Lb between the geometric center FC and the optical center OC of the lens LE, and a radius RC of the roughing grindstone 166.

$$rL=La-Lb-RC \qquad \text{Equation 1}$$

The axis-to-axis distance La is obtained based on the pulse signal from the encoder 150*a* when it is detected that the lens LE is in contact with the roughing grindstone 166. The distance Lb is determined from the FPD value, the PD value of layout data first input, and height data of the optical center OC relative to the geometric center FC of the target lens shape. The radius RC of the roughing grindstone 166 is a known value in terms of design, and stored in the memory 51.

Further, in the case of the boxing center mode, the geometric center FC is the lens chuck center. Thus, based on the radius rL and the layout data (data of a positional relationship between the optical center OC and the geometric center FC), the geometric center FC is replaced with lens outer diameter data (rLEn, θn) (n=1, 2, 3, . . . , N) in which FC or lens chuck center is the center.

The measurement of the outer diameter of the lens LE is preferably performed while the rotation of the roughing grindstone 166 is stopped. However, to shorten the processing time, the measurement may be performed while the roughing grindstone 166 is rotated in order to continuously perform the roughing. In this case, since the roughing grindstone 166 is rotated, a contacted portion of the lens LE is slightly ground. However, the grinding amount is a maximum of about 1 mm, and thus, the radius rL of the lens LE can be approximately obtained. With respect to management of a cutting amount described next, when a grinding amount at the time of measuring the lens outer diameter is estimated, there occurs only a small practical problem. A member to be contacted at the time of measuring the lens outer diameter includes not only the roughing grindstone 166 but also another grindstone attached to the grindstone spindle 161*a*.

The lens edge position measurement portion 200F or 200R may also be used as means for measuring the outer diameter of the unprocessed lens LE. For example, in the same manner as shown in FIG. 5, the control portion 50 rotates the lens LE so that a straight line connecting the optical center OC and the geometric center FC of the target lens shape is positioned on the Y-axis, and thereafter, brings the measurement portion 206F of the lens edge position measurement portion 200F (or the measurement portion 206R of the lens edge position measurement portion 200R) into contact with an area above the target lens shape FT. Subsequently, the control portion 50 controls the Y-axis movement of the lens LE so that the measurement portion 206F moves toward the outer periphery of the lens. When the measurement portion 206F deviates from a state of contacting a refractive surface of the lens LE, detection information of the edge position of the encoder 213F rapidly changes. When the axis-to-axis distance in the Y-axis direction at this time is obtained from the encoder 150*a*, the radius rL which is an outer diameter of the prior-to-be-processed lens LE can be calculated. Further, when the outer diameter of the prior-to-be-processed lens LE is previously known, the operator may input this diameter on a predetermined input screen of the display 5 so as to obtain the outer diameter.

Upon completion of the obtaining step of the lens outer diameter, the process is then moved to a roughing step. Control of roughing in the soft processing mode in order to reduce the axial deviation of the lens LE at the time of roughing as a result of adoption of the up-cut system is described by using FIG. 7 and FIG. 8. In the soft processing mode, the control portion 50 controls an axis-to-axis distance L of the lens chuck shafts 102R and 102L and the grindstone spindle 161*a* or a rotation speed of the lens LE (lens chuck shaft) so that a torque Tθ applied to the lens chuck shafts 102R and 102L falls below a predetermined threshold value Tθs. In the embodiment, the control portion 50 changes the axis-to-axis distance L so as to decrease a cutting amount D so that the torque Tθ falls below the threshold value Tθs. When the torque Tθ falls below the threshold value Tθs, the control portion 50 controls a change of the axis-to-axis distance L so that the cutting amount D reaches a preset cutting setting amount dn.

The torque Tθ is detected by the control portion 50 based on a difference between a rotation command signal (command pulse) to the motor 120 and a detection signal (output pulse) of an actual rotating angle by the encoder 120*a*. Even in the up-cut system of the roughing, the threshold value Tθs in the soft processing mode is set as a value (low value in which an allowance is provided relative to a limit torque Tθr when the axial deviation is generated) that can sufficiently suppress the generation of the axial deviation, and stored in the memory 51. For example, the threshold value Tθs in the soft processing mode is 1.5 Nm (newton meters), and is a value lower than a threshold value TθN (for example, 2.6 Nm) in the normal processing mode described later.

Figure 1A:
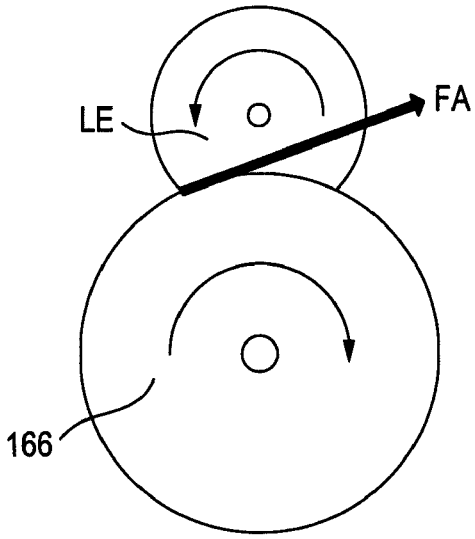
FIG. 1A is an explanatory diagram of a down-cut system.
Figure 1B:
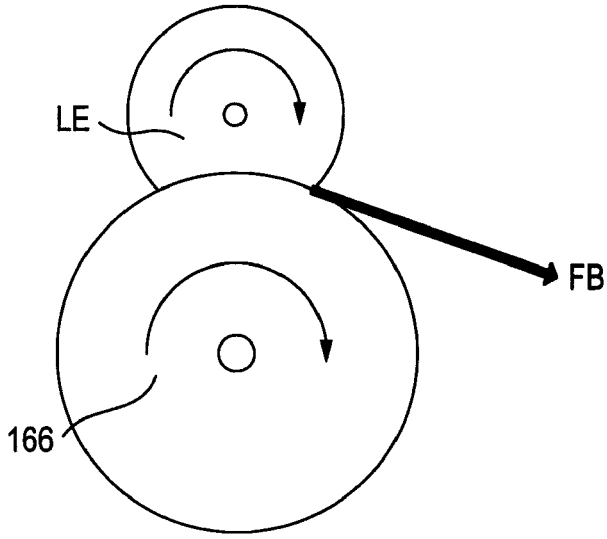
FIG. 1B is an explanatory diagram of an up-cut system.

The cutting setting amount dn in the soft processing mode is set so that the roughing grindstone 166 is not deeply cut even when the torque Tθ falls below the threshold value Tθs. In the up-cut system in which the rotating directions of the roughing grindstone 166 and the lens LE are identical, when the cutting amount D is large (the roughing grindstone 166 bites deeply into the lens LE), the force for pulling the lens LE to the grindstone 166 as indicated by the arrow FB in FIG. 1B increases, and the torque Tθ applied to the lens LE also tends to rapidly increase. When the torque Tθ exceeds the threshold value Tθs and rapidly increases, even if control for decreasing the aforementioned axis-to-axis distance L is performed, the toque Tθ does not immediately fall below the threshold value Tθs, and thus, the axial deviation tends to generate. Further, when the axis-to-axis distance L is rapidly changed greatly, the lens chuck shafts 102R and 102L tend to vibrate, and thus, the axial deviation also tends to generate, and in addition, the detection of the torque Tθ is made unstable. When a limit is provided in the cutting amount D at the time of roughing, these problems can be alleviated so as to alleviate the problems inherent in the up-cut system.

Figure 7A:
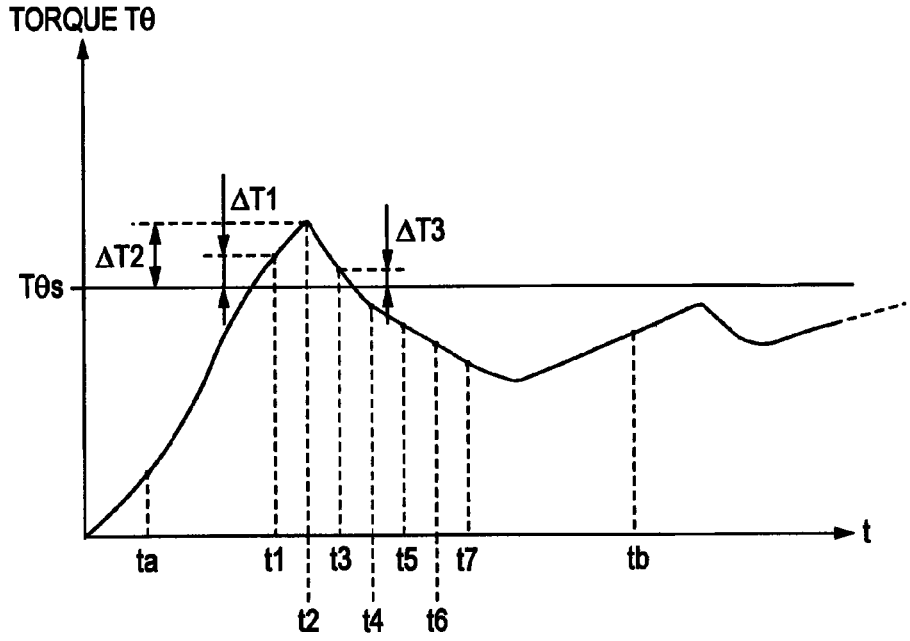
FIG. 7A is an explanatory diagram of control of roughing in a soft processing mode, and shows a chronological change of a torque Tθ.
Figure 7B:
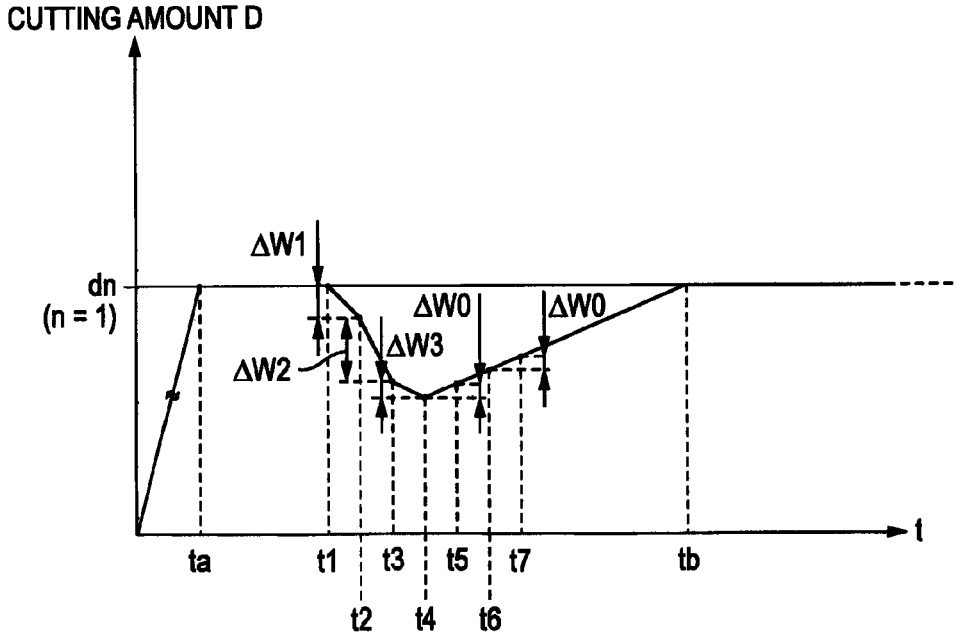
FIG. 7B is an explanatory diagram of control of roughing in a soft processing mode, and shows a chronological change of a cutting amount D.

FIG. 7A and FIG. 7B are graphs each showing a relationship between a change of the torque Tθ and a change of the cutting amount D. FIG. 7A shows a chronological change of the torque Tθ, and FIG. 7B shows a chronological change of the cutting amount D. At the time of starting roughing, the control portion 50, subsequent to the preceding measuring step of the lens outer diameter, moves the lens chuck shafts 102R and 101 to the roughing grindstone 166 side while the lens LE is not allowed to rotate. If the torque Tθ detected by the encoder 120*a* falls below the threshold value Tθs when the cutting amount D reaches the cutting setting amount dn, the control portion 50 rotates the lens LE in the same direction as the rotating direction of the roughing grindstone 166 (up cut). It is noted that the rotation speed of the lens LE is to be rotated at a constant speed.

The control portion 50 rotates the lens LE, and at the same time, advances the axis-to-axis distance L by the cutting setting amount dn while the torque Tθ falls below the threshold value Tθs. Thereafter, as shown in FIG. 7A, when the torque Tθ exceeds the threshold value Tθs by ΔT1 at a time t1, at a time t2 at which the lens LE is rotated by a subsequent predetermined angle Δθ, the control portion 50 controls the axis-to-axis distance L to allow the lens LE to retract by an amount ΔW1 according to ΔT1, relative to the cutting setting amount dn, as shown in FIG. 7B. At the time t2, when the torque Tθ still exceeds by ΔT2 (for example, two times ΔT1) relative to the threshold value Tθs, at a time t3 at which the lens LE is rotated by a subsequent predetermined angle Δθ, the control portion 50 further controls the axis-to-axis distance L so as to allow the lens LE to retract by ΔW2 (two times ΔW1) according to ΔT2. When the torque Tθ at a subsequent time t3 exceeds by ΔT3 (half ΔT1) relative to the threshold value Tθs, the control portion 50 further controls the axis-to-axis distance L at a subsequent time t4 so as to allow the lens LE to retract by ΔW3 (half ΔW1) according to ΔT3. When the cutting amount D is decreased, the torque Tθ is changed to be decreased, and then, falls below the threshold value Tθs. Thereby, a load applied to the lens LE is prevented, and thus, the axial deviation is prevented.

Subsequently, when the torque Tθ detected subsequent to the time t4 falls below the threshold value Tθs, the control portion 50, this time, controls the axis-to-axis distance L so as to increase the cutting amount by a predetermined amount ΔW0 at a subsequent time t5. For example, the control portion 50 pulse-rotates the Y-axis movement motor 150 at each five pulse rotations of the lens rotating motor 120 so as to gradually reduce the axis-to-axis distance L by each certain amount. After this point onward, while the torque Tθ falls below the threshold value Tθs, the control portion 50 rotates the lens LE at a constant speed by each predetermined angle Δθ, and controls the axis-to-axis distance L to gradually increase the cutting amount by a predetermined amount ΔW0 (to increase the cutting amount by a certain inclination). Even when the torque Tθ falls below the threshold value Tθs, at a time tb at which the cutting amount D reaches a preset cutting setting amount dn, the control portion 50 controls to obtain the axis-to-axis distance L of the cutting setting amount dn.

After the second rotation of the lens, similarly, the control portion 50 controls the axis-to-axis distance L so that the torque Tθ stays under the threshold value Tθs, and when the torque Tθ falls below the threshold value Tθs, the control portion 50 controls the axis-to-axis distance L so that the cutting amount D stays under the cutting setting amount dn.

Herein, the cutting setting amount dn may be constant irrespective of the number of rotations of the lens. However, preferably, the control portion 50 increases the cutting setting amount dn in conjunction with an increase in the number of rotations n of the lens LE. When a distance rLE from the rotation center FC to the lens periphery to be roughened is long, the torque applied to the lens LE is large, and when the distance rLE is short, the torque applied to the lens LE also is small. Thus, according to the number of rotations n of the lens LE, when the cutting setting amount dn is increased as the distance rLE becomes shorter, the processing time can be shortened. For example, a cutting setting amount dn at the time of n-th rotation of the lens LE, where α denotes an increase amount of a cutting amount when the number of rotations of the lens LE increases by one rotation, is as follows:

$$dn=d1+(n-1)\times\alpha \quad (n=1,2,3,\ldots) \qquad \text{Equation 2}$$

A first rotation of the lens LE is a cutting setting amount d1, a second rotation is d2=d1+α, and a third rotation is d3=d1+2×α . . . . Herein, the cutting setting amount d1 of the first rotation is set to an amount by which no axial deviation is generated, where average diameter and lens thickness of the lens LE are used as a reference. For example, the cutting setting amount d1 is set to 3 mm and a is set to 0.5 mm. Even when the lens thickness is thicker than the average thickness, by the change of the cutting amount by the axis-to-axis distance L based on the aforementioned detection result of the torque Tθ, the axial deviation can be suppressed.

Figure 8:
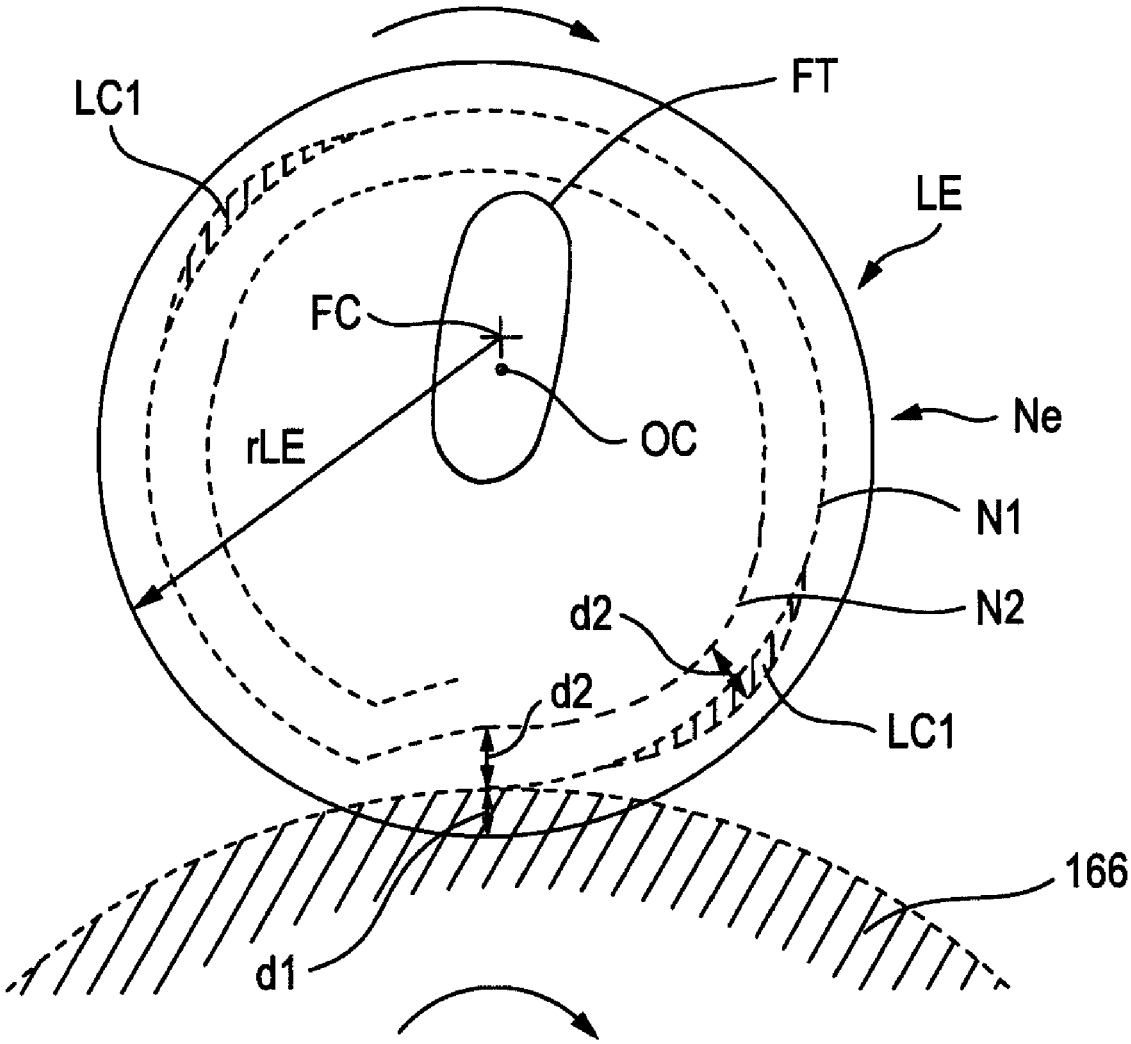
FIG. 8 is a diagram schematically showing a processing path of a lens in a soft processing mode.

FIG. 8 is a diagram schematically showing a processing path of the lens LE by the above-described control. A dotted line N1 which is a next inner line from an outer circumference Ne of the lens LE indicates a path processed by a cutting setting amount d1 of the first rotation of the lens LE. In the actual roughing, at a place where the cutting amount is reduced relative to the cutting setting amount d1 as in ΔW1, ΔW2, etc., in order that the above-described torque Tθ is stayed in the threshold value Tθs, the lens periphery is largely roughened as indicated by a shaded portion LC1. A dotted line N2 which is a next inner line from the dotted line N1 indicates a path processed by the cutting setting amount d2 when the lens LE enters the second rotation. The path N2 of the second rotation is that which is obtained by shortening the axis-to-axis distance L by the cutting setting amount d2 when an outer diameter after one rotation of the lens LE is used as a reference. The processed outer diameter after one rotation of the lens LE can be determined by storing the axis-to-axis distance L controlled by each rotating angle θn of the lens LE in the memory 51. In the roughing of the second rotation of the lens LE, when the axis-to-axis distance L is controlled so that the torque Tθ falls below the threshold value Tθs, the processed outer diameter is cut and ground largely by an retracting amount (ΔW1, ΔW2, etc.) relative to the path N2. A path of the third rotation of the lens LE is that which is obtained by shortening the axis-to-axis distance L by a cutting setting amount d3 when the processed outer diameter is used as a reference. The roughing of the fourth rotation and onward are similarly processed. Finally, the lens periphery is roughened in a shape in which a margin amount of finishing processing, done by bevel grindstone, etc., is left relative to the target lens shape FT.

With respect to the cutting setting amount dn after the second rotation and onward, the thus roughened outer diameter of the lens periphery is preferably used as a reference. However, this process requires a time for arithmetic process of the control portion 50. When the cutting setting amount dn is set by providing an allowance for the axial deviation, in the second rotation of the lens LE, the cutting setting amount d2 may be adopted by using the path N1 as a reference. With respect to the third rotation and onward, the preset path is similarly used as a reference, and controlled by the cutting setting amount. Even in this case, when the axis-to-axis distance L (or the rotation speed of the lens chuck shaft) is controlled so that the torque Tθ applied to the lens chuck shafts 102R and 102L does not exceed the threshold value Tθs, the substantial axial deviation can be suppressed.

By the above-described control of the axis-to-axis distance L, even when the thickness of the lens LE is not known, or even when the thickness is changed depending on the rotating angle of the lens such as an astigmatic lens, the axial deviation in conjunction with the up-cut processing can be suppressed. Further, due to the fact that the up-cut system is adopted, the generation of a large processing noise can be suppressed.

Thus, the control system of the axis-to-axis distance L by the detection of the torque Tθ is described. Further, even when a method in which the rotation speed of the lens LE is controlled is adopted, it is possible to perform processing in which the axial deviation is similarly suppressed. That is, the control portion 50 rotates the lens LE at a constant rotation speed v (speed preset so that no axial deviation is generated) while controlling the axis-to-axis distance L by the cutting setting amount dn, and when the torque Tθ exceeds the threshold value Tθs, the control portion 50 controls the rotation speed of the lens chuck shafts 102R and 102L so as to decelerate the rotation speed of the lens LE according to the difference (ΔT). When the torque Tθ falls below the threshold value Tθs, the control portion 50 gradually accelerates the rotation speed until the rotation speed v is achieved. Thereby, roughing in which the axial deviation is prevented is performed.

Subsequently, a case where the normal processing mode is selected is described. In the processing of the normal plastic lens not processed with water-repellent coating, when the normal processing mode is selected, the processing time can be shortened while suppressing the generation of the axial deviation. In the normal processing mode, the up-cut system in which the lens LE is rotated in the same direction as that of the roughing grindstone 166 is performed. As compared to the soft mode, in the normal processing mode, a value of a threshold value TθN when the axis-to-axis distance L (or the rotation speed of the lens LE) is changed by the detection of the torque Tθ is set high. For example, the threshold value Tθs in the soft mode is 1.5 Nm while the threshold value TθN in the normal processing mode is set to 2.6 Nm. Further, the cutting setting amount dn in the normal processing mode is set larger than in the soft mode. For example, the cutting setting amount d1 in the soft mode is 3 mm while the cutting setting amount d1 in the normal processing mode is set to 5 mm. When the threshold value TθN at the time the axis-to-axis distance L is changed by the detection of the torque Tθ is set higher than at the time of the soft mode, the roughing can be easily processed by the cutting setting amount dn as it is. Further, because the cutting setting amount dn in the normal mode is set larger than that in the soft mode, the number of rotations of the lens LE is reduced at the time of roughing the lens LE to the identical target lens shape. Thereby, the time for roughing is shortened.

After the roughing, the lens chuck shafts 102R and 102L are moved in the X-axis direction and the Y-axis direction, and finishing processing is performed based on the target lens shape data by the finishing grindstone 163 or 164. The finishing processing is beveling and plane edging, and these are processed according to a well-known method, and thus, the description is omitted.

What is claimed is:

1. An eyeglass lens processing apparatus comprising:

a lens rotating unit which includes a motor for rotating a lens chuck shaft for holding an eyeglass lens;

a grindstone rotating unit which includes a motor for rotating a grindstone spindle attached with a roughing grindstone for roughing a periphery of the lens;

an axis-to-axis distance varying unit which includes a motor for varying an axis-to-axis distance between the lens chuck shaft and the grindstone spindle;

a sensor unit which includes a sensor for detecting a torque applied to the lens chuck shaft at the time of roughing of the lens by the roughing grindstone, the torque being a rotation torque for rotating the lens chuck shaft;

a mode selecting switch which switches and selects a soft processing mode for processing a slippery lens coated with a water-repellent substance and a normal processing mode for processing a lens not coated with the water-repellent substance;

a processing control unit which in the normal processing mode, sets a torque threshold value to a value TθN, and controls the axis-to-axis distance varying unit or the lens rotating unit so that the torque detected by the sensor unit is equal to or less than the value TθN, and in the soft processing mode, sets the torque threshold value to a value Tθs lower than the value TθN, and when the torque detected by the sensor unit does not exceed the value Tθs, controls the axis-to-axis distance varying unit or the lens rotating unit so that a cutting amount per rotation of the lens reaches a predetermined cutting amount, and when the detected torque exceeds the value Tθs, controls the axis-to-axis distance varying unit or the lens rotating unit so that the torque becomes lower than the value Tθs to decrease the cutting amount.

2. The eyeglass lens processing apparatus according to claim 1, wherein the processing control unit controls the lens rotating unit and the grindstone rotating unit to rotate the lens chuck shaft and the roughing grindstone in the same direction.

3. The eyeglass lens processing apparatus according to claim 1, wherein the processing control unit controls the axis-to-axis distance varying unit or the lens rotating unit to sequentially increase a cutting amount per rotation of the lens.

4. The eyeglass lens processing apparatus according to claim 1, wherein in the soft processing mode, the processing control unit controls the axis-to-axis distance varying unit or the lens rotating unit to change a decreasing amount of the cutting amount according to a torque amount exceeding the threshold value Tθs.

5. The eyeglass lens processing apparatus according to claim 1, wherein the sensor unit includes a sensor for detecting a rotating angle of the lens chuck shaft and detects the torque based on a deviation between a rotation command signal to the motor provided in the lens rotating unit and a rotating angle of the lens chuck shaft detected by the sensor.

6. The eyeglass lens processing apparatus according to claim 1, wherein in the normal processing mode, the processing control unit controls the axis-to-axis distance varying unit or the lens rotating unit so that the cutting amount per rotation of the lens reaches a predetermined cutting amount larger than the predetermined cutting amount in the soft processing mode.

* * * * *